US012638218B2

(12) United States Patent
Kondou et al.

(10) Patent No.: US 12,638,218 B2
(45) Date of Patent: May 26, 2026

(54) REFRIGERATION DEVICE AND COMPRESSION DEVICE

(71) Applicant: DAIKIN INDUSTRIES, LTD., Osaka (JP)

(72) Inventors: Azuma Kondou, Osaka (JP); Takamasa Itou, Osaka (JP); Chiharu Tomita, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 317 days.

(21) Appl. No.: 18/192,156

(22) Filed: Mar. 29, 2023

(65) Prior Publication Data

US 2023/0235925 A1 Jul. 27, 2023

Related U.S. Application Data

(63) Continuation of application No. PCT/JP2021/021018, filed on Jun. 2, 2021.

(30) Foreign Application Priority Data

Sep. 30, 2020 (JP) ..... 2020-165190

(51) Int. Cl.
*F25B 31/00* (2006.01)
*F25B 7/00* (2006.01)

(52) U.S. Cl.
CPC ..... *F25B 7/00* (2013.01); *F25B 31/004* (2013.01)

(58) Field of Classification Search
CPC ..... F25B 7/00; F25B 31/004; F25B 31/002; F25B 2700/03; F25B 2700/2105; F25B 2500/16; F25B 1/10
See application file for complete search history.

(56) References Cited

U.S. PATENT DOCUMENTS 5,634,345 A * 6/1997 Alsenz ..... F04B 39/0207 62/84
8,109,116 B2 2/2012 Sekiya et al.

FOREIGN PATENT DOCUMENTS

| | | | |
|---|---|---|---|
| EP | 3 312 526 | A1 | 4/2018 |
| EP | 3 040 643 | B1 | 12/2018 |
| JP | 2008-261227 | A | 10/2008 |
| JP | 2010-169337 | A | 8/2010 |
| JP | 2016-161190 | A | 9/2016 |

(Continued)

OTHER PUBLICATIONS

English translation of Oh et al. (KR 20160012383 A). (Year: 2016).*

(Continued)

*Primary Examiner* — Miguel A Diaz
(74) *Attorney, Agent, or Firm* — Birch, Stewart, Kolasch & Birch, LLP

(57) ABSTRACT

A refrigerant circuit includes a first compressor connected to a first suction pipe and a first discharge pipe and configured to compress a refrigerant, a second compressor connected to a second suction pipe and a second discharge pipe and configured to compress the refrigerant discharged from the first compressor, a radiator, and a high-pressure passage connecting the second discharge pipe and the radiator. A first oil drain passage guides an oil in the second compressor to one of the first suction pipe and an intermediate port of the first compressor, without via the high-pressure passage.

18 Claims, 6 Drawing Sheets

(56) References Cited

FOREIGN PATENT DOCUMENTS

| | | | | |
|---|---|---|---|---|
| KR | 10-1599537 | B1 | | 3/2016 |
| KR | 20160012383 | A | * | 3/2016 |

OTHER PUBLICATIONS

International Search Report (PCT/ISA/210) issued in PCT/JP2021/021018, dated Jul. 13, 2021.
Extended European Search Report for European Application No. 21874816.8, dated Feb. 6, 2024.
International Preliminary Report on Patentability and Written Opinion of the International Searching Authority for International Application No. PCT/JP2021/021018, dated Apr. 13, 2023.

* cited by examiner

REFRIGERATION DEVICE AND COMPRESSION DEVICE

CROSS REFERENCE TO RELATED APPLICATIONS

This application is a Continuation of PCT International Application No. PCT/JP2021/021018, filed on Jun. 2, 2021, which claims priority under 35 U.S.C. 119 (a) to Patent Application No. 2020-165190, filed in Japan on Sep. 30, 2020, all of which are hereby expressly incorporated by reference into the present application.

TECHNICAL FIELD

The present disclosure relates to a refrigeration device and a compression device.

BACKGROUND ART

Patent Literature 1 discloses a compression device connected to a refrigerant circuit in an air conditioning system. This compression device includes a plurality of high-pressure dome compressors including a lower stage-side compressor and a higher stage-side compressor, an oil separator disposed on a discharge side of the higher stage-side compressor, an oil return passage through which an oil returns from the oil separator to a suction pipe connected to the lower stage-side compressor, and a higher stage-side oil drain passage through which an oil is guided from a side surface of a casing of the higher stage-side compressor to the oil separator.

CITATION LIST

Patent Literature

Patent Literature 1: JP 2008-261227 A

SUMMARY

An aspect of the present disclosure is directed to a refrigeration device. This refrigeration device includes: a refrigerant circuit (15) including a first compressor (21) connected to a first suction pipe (21*s*) and a first discharge pipe (21*d*) and configured to compress a refrigerant, a second compressor (22) connected to a second suction pipe (22*s*) and a second discharge pipe (22*d*) and configured to compress the refrigerant discharged from the first compressor (21), a radiator (23), and a high-pressure passage (P21) connecting the second discharge pipe (22*d*) and the radiator (23); and a first oil drain passage (P31). The first oil drain passage (P31) guides an oil in the second compressor (22) to one of the first suction pipe (21*s*) and an intermediate port (21*i*) of the first compressor (21), without via the high-pressure passage (P21).

DESCRIPTION OF EMBODIMENTS

Embodiments will be described in detail below with reference to the drawings. In the respective drawings, identical or corresponding portions are denoted with identical reference signs; therefore, the description thereof will not be given repeatedly.

First Embodiment

Figure 1:
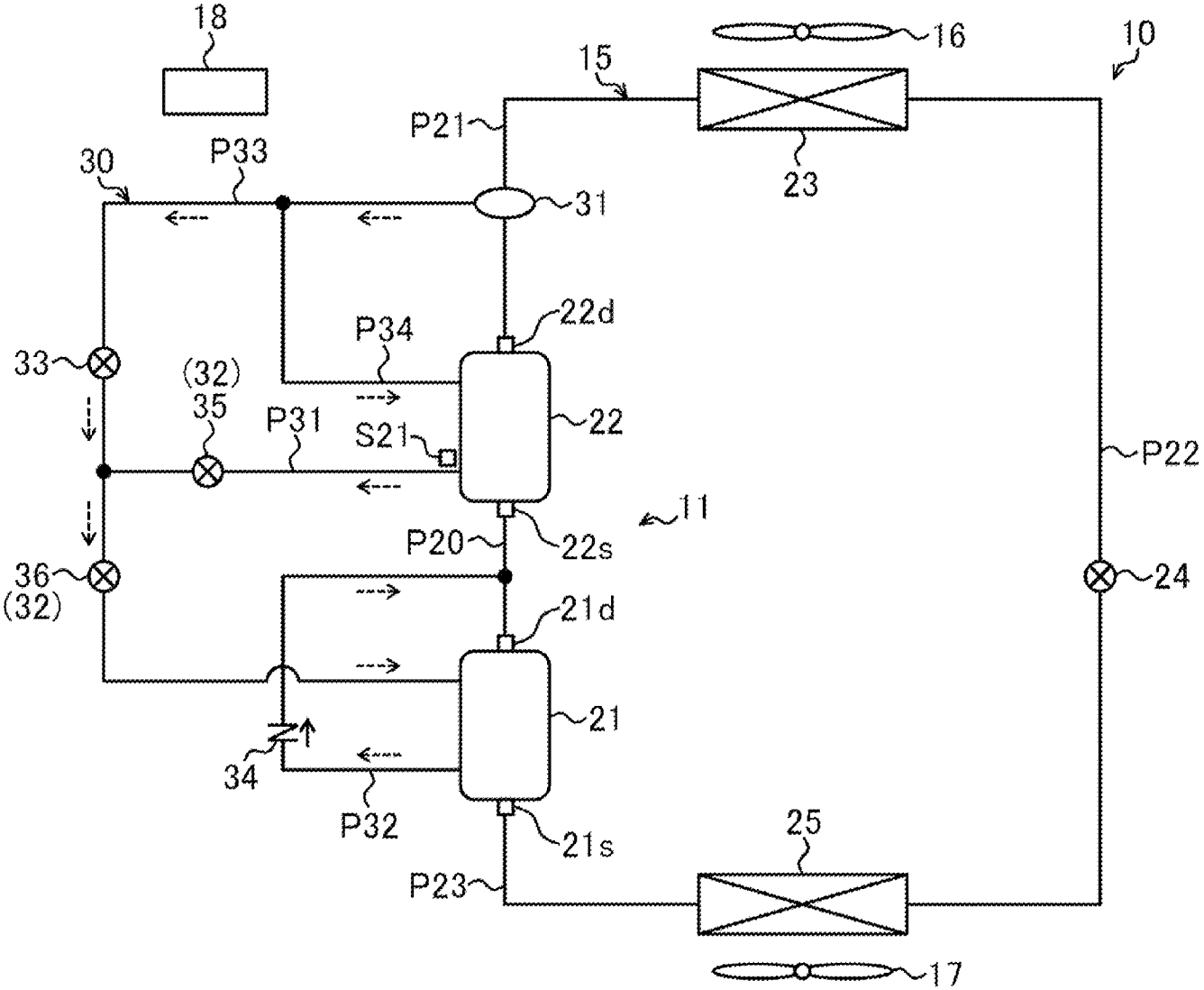
FIG. 1 is a diagram of a piping system as an exemplary configuration of a refrigeration device according to a first embodiment.

FIG. 1 illustrates an exemplary configuration of a refrigeration device (10) according to a first embodiment. For example, the refrigeration device (10) is provided in a cooling system (not illustrated) for cooling a cooling target in a cold chamber, and is configured to cool air in the cold chamber. This cooling system is, for example, a cooling system to be used for manufacturing chilled foods and frozen foods. The refrigeration device (10) includes a refrigerant circuit (15), a heat source fan (16), a utilization fan (17), and a control unit (18).

[Refrigerant Circuit]

The refrigerant circuit (15) is filled with a refrigerant. A refrigeration cycle is achieved in such a manner that the refrigerant circulates through the refrigerant circuit (15). In this example, the refrigerant circuit (15) includes a first compressor (21), a second compressor (22), a heat source heat exchanger (23), an expansion mechanism (24), and a utilization heat exchanger (25). The refrigerant circuit (15) also includes an intermediate passage (P20), a high-pressure passage (P21), a communication passage (P22), and a low-pressure passage (P23). These passages each include, for example, a refrigerant pipe.

<First Compressor>

The first compressor (21) is connected to a first suction pipe (21*s*) and a first discharge pipe (21*d*). The first compressor (21) is configured to compress the refrigerant. Specifically, the first compressor (21) compresses the refrigerant sucked therein through the first suction pipe (21*s*), and discharges the compressed refrigerant through the first discharge pipe (21*d*).

Figure 2:
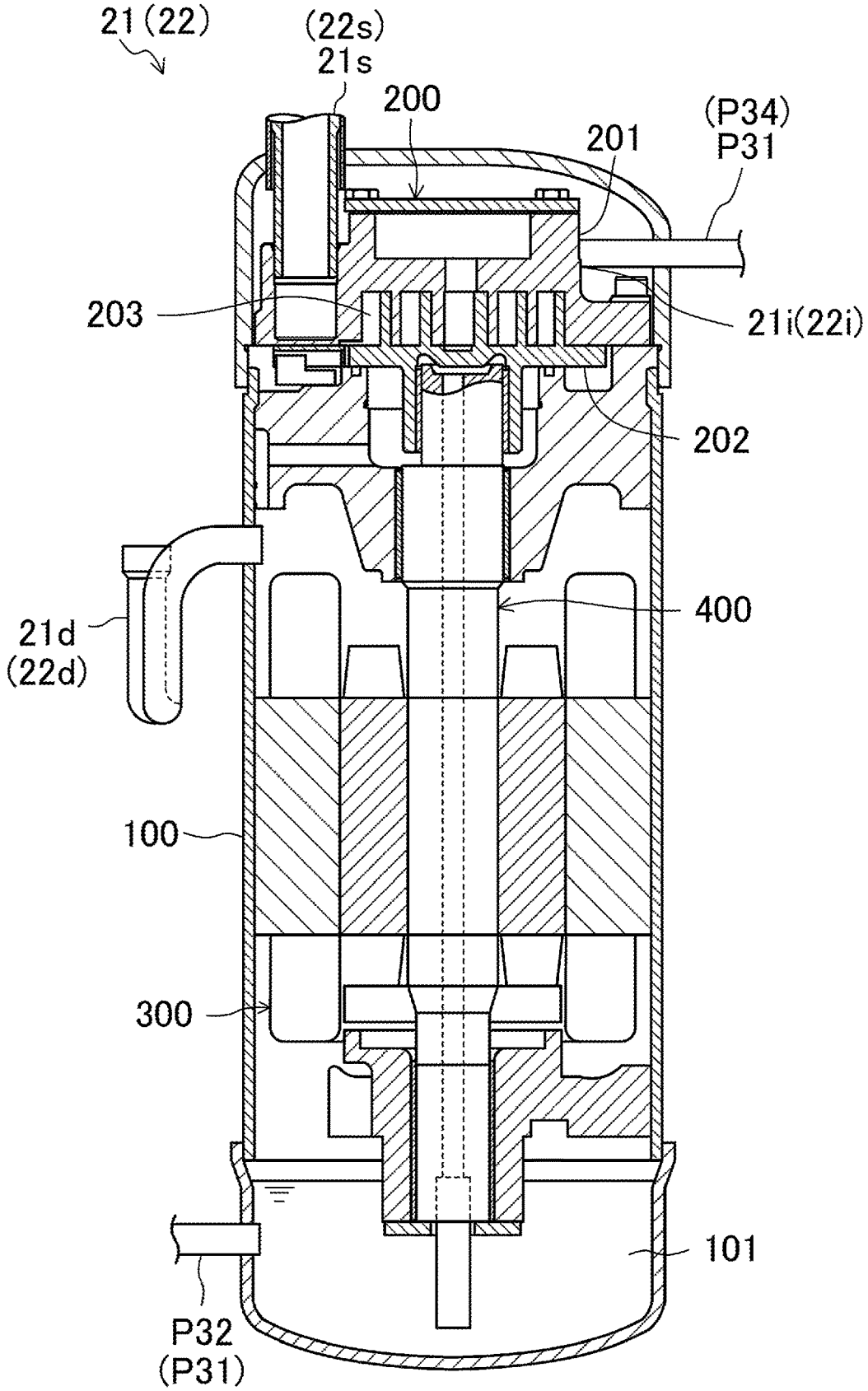
FIG. 2 is a longitudinal sectional view of an exemplary structure of a compressor.

As illustrated in FIG. 2, the first compressor (21) includes a casing (100), a compression mechanism (200), an electric motor (300), and a drive shaft (400). In this example, the first compressor (21) is a rotary compressor. Specifically, the first compressor (21) is a scroll compressor. The first compressor (21) is also a high-pressure dome compressor.

The casing (100) accommodates the compression mechanism (200), the electric motor (300), and the drive shaft (400). The casing (100) includes an oil reservoir (101). The oil reservoir (101) stores an oil (a refrigerating machine oil). In this example, the casing (100) has a both end-closed cylindrical shape and has an axis extending vertically.

The first suction pipe (21*s*) passes through an upper portion of the casing (100) and communicates with a suction port of the compression mechanism (200). The second discharge pipe (22*d*) passes through a body portion of the casing (100) and communicates with an internal space in the casing (100).

The compression mechanism (200) is configured to compress the refrigerant. In this example, the compression mechanism (200) includes a fixed scroll (201) and a movable scroll (202) configured to mesh with the fixed scroll (201). The movable scroll (202) meshes with the fixed scroll (201) to define a compression chamber (203) between the movable scroll (202) and the fixed scroll (201).

The electric motor (300) is driven to rotate the compression mechanism (200). Specifically, the compression mechanism (200) is coupled to the electric motor (300) with the drive shaft (400). When the electric motor (300) is driven, the rotational motion of the electric motor (300) is transmitted to the compression mechanism (200) via the drive shaft (400). The compression mechanism (200) thus rotates.

In this example, in the casing (100), the electric motor (300) is located below the compression mechanism (200). In addition, the electric motor (300) is located above the oil reservoir (101).

When the electric motor (300) is driven to rotate the compression mechanism (200), the refrigerant is sucked into the compression chamber (203) in the compression mechanism (200) through the first suction pipe (21*s*) and is compressed in the compression chamber (203). The refrigerant compressed in the compression chamber (203) is discharged from the compression mechanism (200) through a discharge port of the compression mechanism (200) toward the internal space in the casing (100). The refrigerant in the internal space is discharged from the casing (100) through the first discharge pipe (21*d*).

Also in this example, the first compressor (21) includes an intermediate port (21*i*). The intermediate port (21*i*) of the first compressor (21) communicates with the compression chamber (203) midway through compression by the first compressor (21). The compression chamber (203) midway through the compression by the first compressor (21) is an example of an intermediate-pressure space where a pressure of the refrigerant becomes equal to an intermediate pressure between a suction pressure and a discharge pressure at the first compressor (21) (i.e., an intermediate-pressure space in the first compressor (21)).

<Second Compressor>

As illustrated in FIG. 1, the second compressor (22) is connected to a second suction pipe (22*s*) and a second discharge pipe (22*d*). The second compressor (22) is configured to compress the refrigerant discharged from the first compressor (21). Specifically, the second compressor (22) compresses the refrigerant sucked therein through the second suction pipe (22*s*), and discharges the compressed refrigerant through the second discharge pipe (22*d*). The second compressor (22) is similar in configuration to the first compressor (21).

In this example, the second compressor (22) is a rotary compressor. Specifically, the second compressor (22) is a scroll compressor. The second compressor (22) is also a high-pressure dome compressor. As illustrated in FIG. 2, the second compressor (22) includes a casing (100), a compression mechanism (200), an electric motor (300), and a drive shaft (400).

Also in this example, the second compressor (22) includes an intermediate port (22*i*). The intermediate port (22*i*) of the second compressor (22) communicates with a compression chamber (203) midway through compression by the second compressor (22). The compression chamber (203) midway through the compression by the second compressor (22) is an example of an intermediate-pressure space where a pressure of the refrigerant becomes equal to an intermediate pressure between a suction pressure and a discharge pressure at the second compressor (22) (i.e., an intermediate-pressure space in the second compressor (22)).

<Heat Source Fan>

The heat source fan (16) is disposed near the heat source heat exchanger (23) and is configured to provide heat source air to the heat source heat exchanger (23). The heat source air is, for example, air outside the cold chamber of the cooling system.

<Heat Source Heat Exchanger (Radiator)>

The heat source heat exchanger (23) is configured to cause the refrigerant flowing through the heat source heat exchanger (23) to exchange heat with the heat source air provided to the heat source heat exchanger (23). The heat source heat exchanger (23) is, for example, a fin-and-tube heat exchanger. In this example, the heat source heat exchanger (23) functions as a radiator.

<Utilization Fan>

The utilization fan (17) is disposed near the utilization heat exchanger (25) and is configured to provide utilization air to the utilization heat exchanger (25). The utilization air is, for example, air in the cold chamber of the cooling system.

<Utilization Heat Exchanger (Evaporator)>

The utilization heat exchanger (25) is configured to cause the refrigerant flowing through the utilization heat exchanger (25) to exchange heat with the utilization air provided to the utilization heat exchanger (25). The utilization heat exchanger (25) is, for example, a fin-and-tube heat exchanger. In this example, the utilization heat exchanger (25) functions as an evaporator.

<Passages>

The intermediate passage (P20) connects the first discharge pipe (21*d*) connected to the first compressor (21) and the second suction pipe (22*s*) connected to the second compressor (22). The high-pressure passage (P21) connects the second discharge pipe (22*d*) connected to the second compressor (22) and a gas end of the heat source heat exchanger (23). The communication passage (P22) connects a liquid end of the heat source heat exchanger (23) and a liquid end of the utilization heat exchanger (25). The low-pressure passage (P23) connects a gas end of the utilization heat exchanger (25) and the first suction pipe (21*s*) connected to the first compressor (21).

<Expansion Mechanism>

The expansion mechanism (24) is disposed on the communication passage (P22) and is configured to decompress the refrigerant. In this example, the expansion mechanism (24) includes an expansion valve having an adjustable opening degree. The expansion mechanism (24) includes, for example, an electric valve.

[Oil Circuit]

The refrigerant circuit (15) is provided with an oil circuit (30). An oil circulates through the oil circuit (30). In FIG. 1, a broken arrow indicates a flow of the oil in the oil circuit (30).

The oil circuit (30) includes an oil separator (31), an oil drain valve (32), an oil feed valve (33), and a drain oil check valve (34). In this example, the oil circuit (30) includes two oil drain valves (32). One of the two oil drain valves (32) is an upstream oil drain valve (35), and the other is a downstream oil drain valve (36). The oil circuit (30) also includes a first oil drain passage (P31), a second oil drain passage (P32), a first oil feed passage (P33), and a second oil feed passage (P34). These passages each include, for example, an oil pipe.

<First Oil Drain Passage>

The first oil drain passage (P31) guides the oil in the second compressor (22) to one of the first suction pipe (21*s*) connected to the first compressor (21) and the intermediate port (21*i*) of the first compressor (21), without via the high-pressure passage (P21). In this example, the first oil drain passage (P31) guides the oil in the second compressor (22) to the intermediate port (21*i*) of the first compressor (21). Specifically, the first oil drain passage (P31) has an inlet connected to the second compressor (22). The first oil drain passage (P31) also has an outlet connected to the intermediate port (21*i*) of the first compressor (21).

As illustrated in FIG. 2, the inlet of the first oil drain passage (P31) is located lower than the electric motor (300) in the casing (100) of the second compressor (22). When the level of the oil stored in the oil reservoir (101) of the second compressor (22) becomes higher in height than the inlet of the first oil drain passage (P31), the oil in the oil reservoir (101) of the second compressor (22) flows out of the second compressor (22) through the first oil drain passage (P31).

Also in this example, a pressure at an inlet side of the first oil drain passage (P31) corresponds to a pressure in the second compressor (22) (i.e., a pressure of the refrigerant compressed by the second compressor (22)). In addition, a pressure at an outlet side of the first oil drain passage (P31) corresponds to an intermediate pressure in the first compressor (21) (i.e., a pressure between the suction pressure and the discharge pressure). The pressure in the second compressor (22) is higher than the intermediate pressure in the first compressor (21). The pressure difference between the inlet side and the outlet side of the first oil drain passage (P31) allows the oil in the second compressor (22) to be guided to the intermediate port (21*i*) of the first compressor (21) through the first oil drain passage (P31).

<Second Oil Drain Passage>

The second oil drain passage (P32) guides the oil in the first compressor (21) to the intermediate passage (P20). Specifically, the second oil drain passage (P32) has an inlet connected to the first compressor (21). The second oil drain passage (P32) also has an outlet connected to the intermediate passage (P20).

As illustrated in FIG. 2, the inlet of the second oil drain passage (P32) is located lower than the electric motor (300) in the casing (100) of the first compressor (21). When the level of the oil stored in the oil reservoir (101) of the first compressor (21) becomes higher in height than the inlet of the second oil drain passage (P32), the oil in the oil reservoir (101) of the first compressor (21) flows out of the first compressor (21) through the second oil drain passage (P32).

Also in this example, a pressure at an inlet side of the second oil drain passage (P32) corresponds to a pressure in the first compressor (21) (i.e., a pressure of the refrigerant compressed by the first compressor (21)). On the other hand, a pressure at an outlet side of the second oil drain passage (P32) is lower than the pressure in the first compressor (21) by a pressure loss at a passage from "the first discharge pipe (21*d*) connected to the first compressor (21)" to "a joint between the intermediate passage (P20) and the outlet of the second oil drain passage (P32)". The pressure difference between the inlet side and the outlet side of the second oil drain passage (P32) allows the oil in the first compressor (21) to be guided to the intermediate passage (P20) through the second oil drain passage (P32).

It should be noted that the oil in the first compressor (21) may be guided to the intermediate passage (P20) through the second oil drain passage (P32), using a difference in height (i.e., a difference in position head) between the inlet and the outlet of the second oil drain passage (P32). For example, the outlet of the second oil drain passage (P32) may be located lower than the inlet of the second oil drain passage (P32).

<Oil Separator>

The oil separator (31) is disposed on the high-pressure passage (P21) and is configured to separate the oil from the refrigerant discharged from the second compressor (22).

<First Oil Feed Passage>

The first oil feed passage (P33) is configured to guide the oil in the oil separator (31) to the first oil drain passage (P31). Specifically, the first oil feed passage (P33) has an inlet connected to the oil separator (31). The first oil feed passage (P33) also has an outlet connected to the first oil drain passage (P31).

<Second Oil Feed Passage>

The second oil feed passage (P34) is configured to guide the oil in the oil separator (31) to the second compressor (22). In this example, the second oil feed passage (P34) guides the oil in the oil separator (31) to the intermediate port (22*i*) of the second compressor (22). The second oil feed passage (P34) has an inlet connected to the first oil feed passage (P33). The second oil feed passage (P34) also has an outlet connected to the intermediate port (22*i*) of the second compressor (22).

<Upstream Oil Drain Valve>

The upstream oil drain valve (35) is disposed upstream of a joint between the first oil drain passage (P31) and the first oil feed passage (P33), on the first oil drain passage (P31). The upstream oil drain valve (35) has an adjustable opening degree. The upstream oil drain valve (35) is, for example, an electric valve. It should be noted that the upstream oil drain valve (35) is an example of the oil drain valve (32) disposed on the first oil drain passage (P31).

<Downstream Oil Drain Valve>

The downstream oil drain valve (36) is disposed downstream of the joint between the first oil drain passage (P31) and the first oil feed passage (P33), on the first oil drain passage (P31). The downstream oil drain valve (36) has an adjustable opening degree. The downstream oil drain valve (36) is, for example, an electric valve. It should be noted that the downstream oil drain valve (36) is an example of the oil drain valve (32) disposed on the first oil drain passage (P31).

<Oil Feed Valve>

The oil feed valve (33) is disposed on the first oil feed passage (P33). In this example, the oil feed valve (33) is disposed downstream of a joint between the first oil feed passage (P33) and the second oil feed passage (P34), on the first oil feed passage (P33). The oil feed valve (33) has an adjustable opening degree. The oil feed valve (33) is, for example, an electric valve.

<Drain Oil Check Valve>

The drain oil check valve (34) is disposed on the second oil drain passage (P32). The drain oil check valve (34) permits a flow of the oil from the first compressor (21) to the intermediate passage (P20) and prohibits a flow of the oil from the intermediate passage (P20) to the first compressor (21).

[Various Sensors]

The refrigeration device (10) includes various sensors (not illustrated) such as a pressure sensor and a temperature sensor. Examples of physical quantities to be detected by these various sensors may include, but not limited to, a pressure and a temperature of the high-pressure refrigerant in the refrigerant circuit (15), a pressure and a temperature of the low-pressure refrigerant in the refrigerant circuit (15), a pressure and a temperature of the refrigerant in the heat source heat exchanger (23), a temperature of air to be provided to the heat source heat exchanger (23), a pressure and a temperature of the refrigerant in the utilization heat exchanger (25), and a temperature of air to be provided to the utilization heat exchanger (25). The various sensors each transmit a detection signal indicating a detection result to the control unit (18).

In this example, the various sensors of the refrigeration device (10) include a temperature sensor (S21). The temperature sensor (S21) is configured to detect a temperature of the oil on the first oil drain passage (P31). Specifically, the temperature sensor (S21) is placed near a joint between the first oil drain passage (P31) and the second compressor (22) and is configured to detect a temperature of the oil at this place.

[Control Unit]

Figure 3:
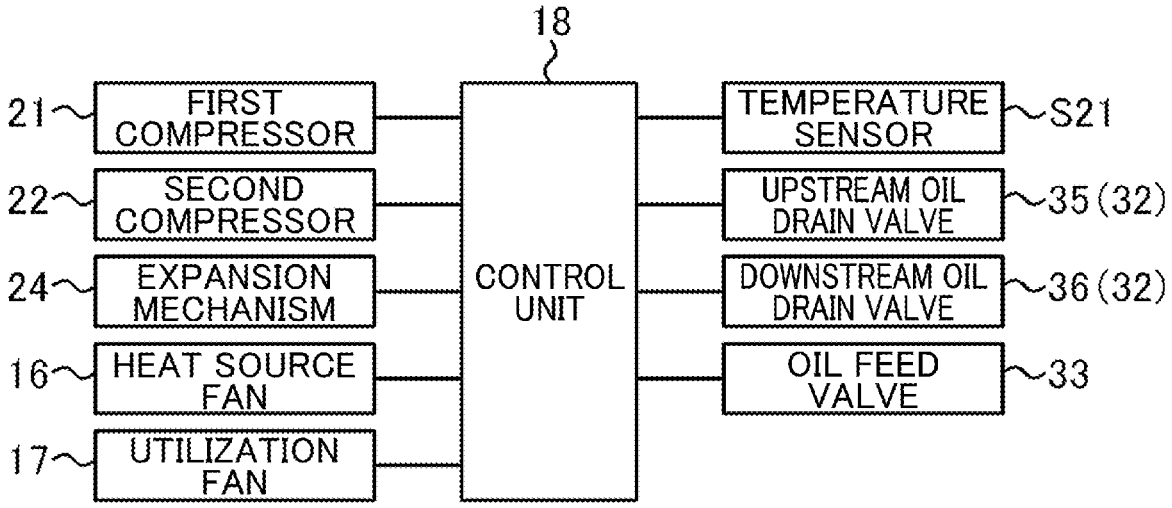
FIG. 3 is a block diagram of an exemplary configuration of a control unit according to the first embodiment.

The control unit (18) is connected to the various sensors of the refrigeration device (10) and the constituent elements of the refrigeration device (10), through communication lines. As illustrated in FIG. 3, the control unit (18) is connected to, for example, the first compressor (21), the second compressor (22), the expansion mechanism (24), the heat source fan (16), the utilization fan (17), the upstream oil drain valve (35), the downstream oil drain valve (36), the oil feed valve (33), and the temperature sensor (S21). The control unit (18) receives an external signal transmitted outside the refrigeration device (10). The control unit (18) controls the respective constituent elements of the refrigeration device (10), based on detection signals from the various sensors of the refrigeration device (10) and the external signal transmitted outside the refrigeration device (10). The action of the refrigeration device (10) is thus controlled.

The control unit (18) includes, for example, a processor and a memory electrically connected to the processor and storing programs and information for operating the processor. Various functions of the control unit (18) are achieved in such a manner that the processor executes the programs.

[Compression Device]

In the refrigeration device (10) according to the first embodiment, the first compressor (21), the second compressor (22), the intermediate passage (P20), the high-pressure passage (P21), and the oil circuit (30) constitute a compression device (11). The compression device (11) is configured to supply the compressed refrigerant to a radiator (the heat source heat exchanger (23) in this example).

[Operation]

Next, a description will be given of an operation to be carried out by the refrigeration device (10) according to the first embodiment. The refrigeration device (10) according to the first embodiment carries out a cooling operation.

During the cooling operation, the first compressor (21), the second compressor (22), the heat source fan (16), and the utilization fan (17) are driven. The heat source heat exchanger (23) functions as a radiator while the utilization heat exchanger (25) functions as an evaporator. An amount of decompression of the refrigerant in the expansion mechanism (24) is adjusted. For example, the control unit (18) controls the amount of decompression of the refrigerant in the expansion mechanism (24) (i.e., the opening degree of the expansion valve) such that a degree of superheating of the refrigerant flowing out of the utilization heat exchanger (25) becomes equal to a target degree of superheating.

[Flow of Refrigerant During Operation]

Next, a description will be given of the flow of the refrigerant during the cooling operation carried out by the refrigeration device (10) according to the first embodiment.

The refrigerant is discharged from the first compressor (21). The refrigerant then flows through the intermediate passage (P20). The refrigerant is then sucked into and compressed by the second compressor (22). The refrigerant (the high-pressure refrigerant) is then discharged from the second compressor (22). The refrigerant then flows into the heat source heat exchanger (23) via the high-pressure passage (P21) and dissipates heat in the heat source heat exchanger (23). The refrigerant then flows out of the heat source heat exchanger (23). The refrigerant is then decompressed by the expansion mechanism (24). The refrigerant then evaporates in the utilization heat exchanger (25). The refrigerant (the low-pressure refrigerant) then flows out of the utilization heat exchanger (25). The refrigerant then passes through the low-pressure passage (P23). The refrigerant is then sucked into and compressed by the first compressor (21).

[Flow of Oil During Operation]

Next, a description will be given of the flow of the oil during the cooling operation carried out by the refrigeration device (10) according to the first embodiment.

The oil flows out of the second compressor (22) and then flows into the first oil drain passage (P31). The oil then passes through the upstream oil drain valve (35) and the downstream oil drain valve (36) on the first oil drain passage (P31). The oil then flows into the first compressor (21) through the intermediate port (21*i*). After flowing into the first compressor (21) through the intermediate port (21*i*), the oil is guided to the compression chamber (203) midway through the compression by the first compressor (21), to seal a clearance between the fixed scroll (201) and the movable scroll (202) of the first compressor (21).

The oil then flows out of the first compressor (21) and flows into the second oil drain passage (P32). The oil then passes through the drain oil check valve (34) on the second oil drain passage (P32) and flows into the intermediate passage (P20). The oil is then sucked into the second compressor (22).

The oil then flows out of the oil separator (31) and flows into the first oil feed passage (P33). A part of the oil then passes through the second oil feed passage (P34) and flows into the second compressor (22) through the intermediate port (22*i*) while the remaining flows into the first oil drain passage (P31) via the oil feed valve (33). After flowing into the second compressor (22) through the intermediate port (22*i*), the oil is guided to the compression chamber (203) midway through the compression by the second compressor (22), to seal a clearance between the fixed scroll (201) and the movable scroll (202) of the second compressor (22).

[Control of Oil Drain Valve and Oil Feed Valve]

In the refrigeration device (10) according to the first embodiment, the control unit (18) controls the oil drain valves (32) and the oil feed valve (33) during the cooling operation. In controlling the oil drain valves (32), the control unit (18) switches between an open state and a closed state of each oil drain valve (32) and adjusts the opening degree of each oil drain valve (32). In controlling the oil feed valve (33), the control unit (18) switches between an open state and a closed state of the oil feed valve (33) and adjusts the opening degree of the oil feed valve (33). For example, the control unit (18) controls the oil drain valves (32) as follows.

The control unit (18) determines whether a temperature of the oil detected by the temperature sensor (S21) is equal to or less than a predetermined first temperature. The temperature of the oil detected by the temperature sensor (S21) indicates a temperature of the oil on the first oil drain passage (P31).

When the temperature of the oil detected by the temperature sensor (S21) is equal to or less than the first temperature, the control unit (18) brings each oil drain valve (32) into the open state. In this example, the control unit (18) brings each of the upstream oil drain valve (35) and the downstream oil drain valve (36) into the open state.

When the temperature of the oil detected by the temperature sensor (S21) is more than the first temperature, the control unit (18) brings one of or each of the oil drain valves (32) into the closed state. In this example, the control unit (18) brings one of or each of the upstream oil drain valve (35) and the downstream oil drain valve (36) into the closed state.

Description of Comparative Example

Next, a description will be given of a comparative example to be compared with the refrigeration device (10) according to the first embodiment. For convenience of the description, a refrigeration device according to a comparative example is described using reference signs similar to those for the refrigeration device (10) according to the first embodiment.

In the refrigeration device according to the comparative example, a first oil drain passage (P31) is configured to guide an oil in a second compressor (22) to an oil separator (31). In the refrigeration device according to the comparative example, specifically, the first oil drain passage (P31) has an outlet connected to the oil separator (31). In the refrigeration device according to the comparative example, the first oil drain passage (P31) corresponds to "the higher stage-side oil drain passage" disclosed in Patent Literature 1.

In the refrigeration device according to the comparative example, for example, a pressure loss at a passage from the second compressor (22) to the oil separator (31) causes a minute pressure difference between an inlet side and an outlet side of the first oil drain passage (P31). This minute pressure difference causes the oil in the second compressor (22) to be guided to the oil separator (31) through the first oil drain passage (P31).

However, the refrigeration device according to the comparative example may fail to make an adequate pressure difference between the inlet side and the outlet side of the first oil drain passage (P31), depending on operating conditions, and may be less likely to appropriately adjust an amount of the oil in the second compressor (22). Such a disadvantage is likely to occur under low load when a relatively low load is placed on the second compressor (22) so that the number of rotations of the second compressor (22) is relatively small (i.e., in unloading). It should be noted that the oil is discharged together with a refrigerant from the second compressor (22) with ease under high load when a relatively high load is placed on the second compressor (22) so that the number of rotations of the second compressor (22) is relatively large. It is therefore important to discharge the oil in the second compressor (22) through the first oil drain passage (P31) under low load.

In the refrigeration device according to the comparative example, moreover, there is a possibility that the oil in the oil separator (31) flows back through the first oil drain passage (P31) and returns to the second compressor (22) during a stop of the second compressor (22). It is therefore necessary to take measures for preventing the backflow of the oil. For example, it is necessary to make a difference in height between the inlet side and the outlet side of the first oil drain passage (P31) or it is necessary to provide a check valve on the first oil drain passage (P31).

Also in the refrigeration device according to the comparative example, the oil in the second compressor (22) is guided to the oil separator (31) through the first oil drain passage (P31) and then is stored in the oil separator (31). Consequently, the oil in the oil separator (31) flows into the refrigerant circuit (15) with ease. An increase in amount of the oil flowing out of the oil separator (31), flowing into the refrigerant circuit (15), and circulating through the refrigerant circuit (15) may degrade the efficiency of the refrigerant circuit (15). For example, the amount of the refrigerant circulating through the refrigerant circuit (15) may be reduced or the heat exchange efficiency of the utilization heat exchanger (25) may be degraded if the oil is stored in the utilization heat exchanger (25) functioning as an evaporator.

Advantageous Effects of First Embodiment

In the refrigeration device (10) according to the first embodiment, the first oil drain passage (P31) guides the oil in the second compressor (22) to one of the first suction pipe (21*s*) connected to the first compressor (21) and the intermediate port (21*i*) of the first compressor (21) (the intermediate port (21*i*) of the first compressor (21) in this example), without via the high-pressure passage (P21).

The refrigeration device (10) having this configuration is capable of making an adequate pressure difference between the inlet side and the outlet side of the first oil drain passage (P31). Specifically, the pressure difference between the inlet side and the outlet side of the first oil drain passage (P31) can be made larger than the pressure difference between the inlet side and the outlet side of the higher stage-side oil drain passage disclosed in Patent Literature 1. The refrigeration device (10) is thus capable of appropriately discharging the oil in the second compressor (22) through the first oil drain passage (P31), and is therefore capable of appropriately adjusting the amount of the oil in the second compressor (22) which is a higher stage-side compressor.

Also in the refrigeration device (10) according to the first embodiment, the first oil drain passage (P31) guides the oil in the second compressor (22) to the first compressor (21), without via the oil separator (31) on the high-pressure passage (P21).

According to this configuration, the oil flowing out of the second compressor (22) and then flowing into the first oil drain passage (P31) is not stored in the oil separator (31). Therefore, the oil in the oil separator (31) is less likely to flow into the refrigerant circuit (15) as compared with a case where the oil flowing out of the second compressor (22) and then flowing into the first oil drain passage (P31) is stored in the oil separator (31). The refrigeration device (10) is therefore capable of suppressing degradation in efficiency of the refrigerant circuit (15) due to the flow of the oil in the oil separator (31) into the refrigerant circuit (15).

Also in the refrigeration device (10) according to the first embodiment, the first oil feed passage (P33) guides the oil in the oil separator (31) to the first oil drain passage (P31).

The refrigeration device (10) having this configuration is capable of unifying a part of the passage that guides the oil in the second compressor (22) to the first compressor (21) and a part of the passage that guides the oil in the oil separator (31) to the first compressor (21). According to this configuration, these passages can be connected to the first compressor (21) in a single place.

Also in the refrigeration device (10) according to the first embodiment, the second oil feed passage (P34) guides the oil in the oil separator (31) to the second compressor (22).

The refrigeration device (10) having this configuration is capable of returning the oil in the oil separator (31) to the second compressor (22).

Also in the refrigeration device (10) according to the first embodiment, the second oil feed passage (P34) guides the oil in the oil separator (31) to the intermediate port (22*i*) of the second compressor (22).

The refrigeration device (10) having this configuration is capable of suppressing degradation in efficiency of the second compressor (22), as compared with a case where the second oil feed passage (P34) guides the oil in the oil separator (31) to the second suction pipe (22*s*) connected to the second compressor (22).

Also in the refrigeration device (10) according to the first embodiment, the inlet of the second oil feed passage (P34) is connected to the first oil feed passage (P33).

The refrigeration device (10) having this configuration is capable of unifying a part of the passage that guides the oil in the oil separator (31) to the first oil drain passage (P31) and a part of the passage that guides the oil in the oil separator (31) to the second compressor (22). According to this configuration, these passages can be connected to the oil separator (31) in a single place.

Also in the refrigeration device (10) according to the first embodiment, the oil drain valve (32) is disposed on the first oil drain passage (P31).

The refrigeration device (10) having this configuration is capable of adjusting the amount of the oil flowing through the first oil drain passage (P31), by controlling the oil drain valve (32). The refrigeration device (10) is capable of adjusting the amount of the oil discharged from the second compressor (22) through the first oil drain passage (P31), and is therefore capable of appropriately adjusting the amount of the oil in the second compressor (22).

Also in the refrigeration device (10) according to the first embodiment, the upstream oil drain valve (35) is disposed upstream of the joint between the first oil drain passage (P31) and the first oil feed passage (P33), on the first oil drain passage (P31).

The refrigeration device (10) having this configuration is capable of adjusting, by controlling the upstream oil drain valve (35), the amount of the oil flowing through the first oil drain passage (P31) from the second compressor (22) toward the joint between the first oil drain passage (P31) and the first oil feed passage (P33). The refrigeration device (10) is thus capable of adjusting the amount of the oil returning to the first compressor (21) through the first oil drain passage (P31), and is therefore capable of appropriately adjusting the amount of the oil in the first compressor (21).

Also in the refrigeration device (10) according to the first embodiment, the downstream oil drain valve (36) is disposed downstream of the joint between the first oil drain passage (P31) and the first oil feed passage (P33), on the first oil drain passage (P31).

The refrigeration device (10) having this configuration is capable of adjusting, by controlling the downstream oil drain valve (36), the amount of the oil flowing through the first oil drain passage (P31) from the joint between the first oil drain passage (P31) and the first oil feed passage (P33) toward the first compressor (21). The refrigeration device (10) is thus capable of adjusting the amount of the oil discharged from the second compressor (22) through the first oil drain passage (P31), and is therefore capable of appropriately adjusting the amount of the oil in the second compressor (22).

Also in the refrigeration device (10) according to the first embodiment, the control unit (18) brings each oil drain valve (32) into the open state on condition that the temperature of the oil detected by the temperature sensor (S21) is equal to or less than the predetermined first temperature and brings each oil drain valve (32) into the closed state on condition that the temperature of the oil detected by the temperature sensor (S21) is more than the first temperature.

The refrigeration device (10) having this configuration is capable of inhibiting the high-temperature oil from flowing from the second compressor (22) into the first compressor (21) through the first oil drain passage (P31).

Also in the refrigeration device (10) according to the first embodiment, the oil feed valve (33) is disposed on the first oil feed passage (P33).

The refrigeration device (10) having this configuration is capable of adjusting the amount of the oil flowing through the first oil feed passage (P33), by controlling the oil feed valve (33). The refrigeration device (10) is thus capable of adjusting the amount of the oil discharged from the oil separator (31) through the first oil feed passage (P33), and is therefore capable of appropriately adjusting the amount of the oil in the oil separator (31).

Also in the refrigeration device (10) according to the first embodiment, the second oil drain passage (P32) guides the oil in the first compressor (21) to the intermediate passage (P20) connecting the first discharge pipe (21*d*) and the second suction pipe (22*s*).

The refrigeration device (10) having this configuration is capable of appropriately discharging the oil in the first compressor (21) through the second oil drain passage (P32). The refrigeration device (10) is thus capable of appropriately adjusting the amount of the oil in the first compressor (21) which is a lower stage-side compressor.

Also in the refrigeration device (10) according to the first embodiment, the inlet of the first oil drain passage (P31) is located lower than the electric motor (300) in the casing (100) of the second compressor (22).

The refrigeration device (10) having this configuration is capable of preventing the electric motor (300) from being immersed in the oil in the second compressor (22). The refrigeration device (10) is thus capable of suppressing degradation in efficiency of the second compressor (22).

Also in the refrigeration device (10) according to the first embodiment, the first compressor (21) includes the fixed scroll (201) and the movable scroll (202) configured to mesh with the fixed scroll (201) to define the compression chamber (203) between the movable scroll (202) and the fixed scroll (201). The intermediate port (21*i*) of the first compressor (21) communicates with the compression chamber (203) midway through the compression by the first compressor (21). The first oil drain passage (P31) guides the oil in the second compressor (22) to the intermediate port (21*i*) of the first compressor (21), without via the high-pressure passage (P21).

The refrigeration device (10) having this configuration is capable of guiding the oil in the second compressor (22) to the compression chamber (203) midway through the compression by the first compressor (21), through the first oil drain passage (P31). The refrigeration device (10) is thus capable of sealing the clearance between the fixed scroll (201) and the movable scroll (202) with the oil.

Modification of First Embodiment

Figure 4:
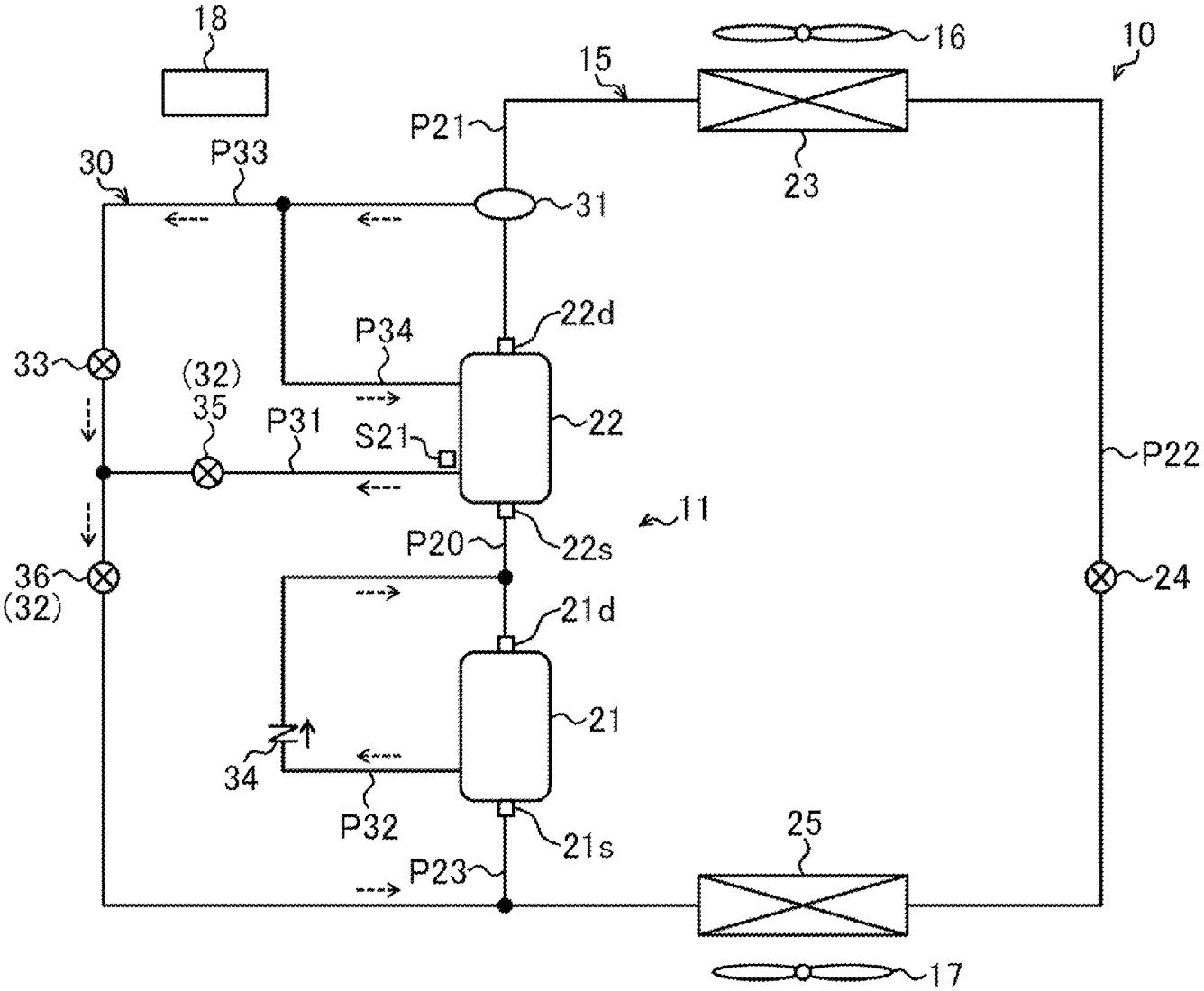
FIG. 4 is a diagram of a piping system of a refrigeration device according to a modification of the first embodiment.

FIG. 4 illustrates an exemplary configuration of a refrigeration device (10) according to a modification of the first embodiment. The refrigeration device (10) according to the modification of the first embodiment is similar in configuration to the refrigeration device (10) according to the first embodiment, except a first compressor (21) and a first oil drain passage (P31).

According to the modification of the first embodiment, the first compressor (21) does not include an intermediate port (21*i*). The first oil drain passage (P31) guides an oil in a second compressor (22) to a first suction pipe (21*s*) connected to the first compressor (21), without via a high-pressure passage (P21). Specifically, the first oil drain passage (P31) has an inlet connected to the second compressor (22). The first oil drain passage (P31) also has an outlet connected to the first suction pipe (21*s*) connected to the first compressor (21).

In this modification, a pressure at an inlet side of the first oil drain passage (P31) corresponds to a pressure in the second compressor (22) (i.e., a pressure of the refrigerant compressed by the second compressor (22)). In addition, a pressure at an outlet side of the first oil drain passage (P31) corresponds to a suction pressure in the first compressor (21). The pressure in the second compressor (22) is higher than the suction pressure in the first compressor (21). The pressure difference between the inlet side and the outlet side of the first oil drain passage (P31) allows the oil in the second compressor (22) to be guided to the first suction pipe (21*s*) connected to the first compressor (21), through the first oil drain passage (P31).

Advantageous Effects of Modification of First Embodiment

The refrigeration device (10) according to the modification of the first embodiment is capable of producing advantageous effects similar to the advantageous effects of the refrigeration device (10) according to the first embodiment.

Second Embodiment

Figure 5:
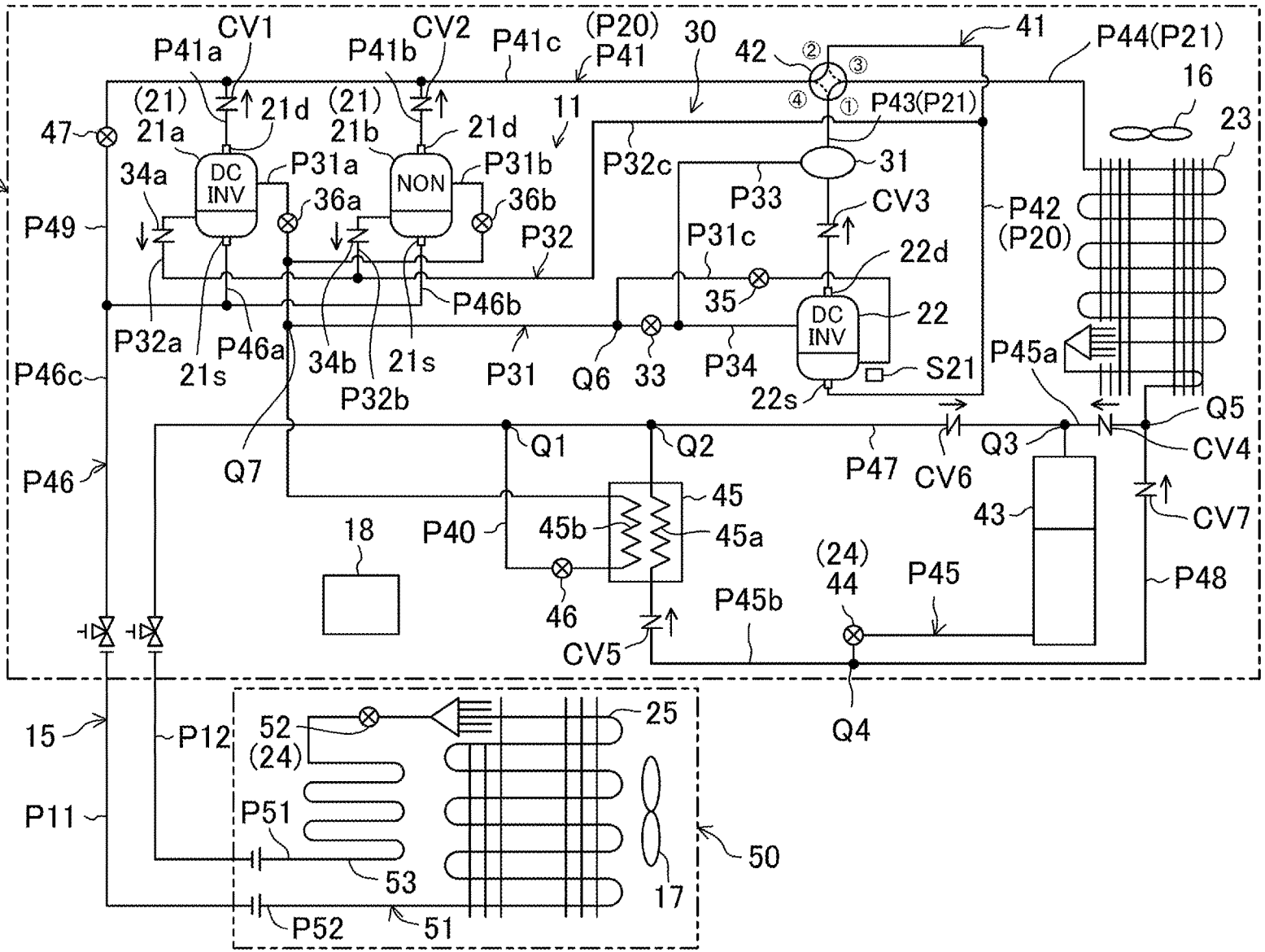
FIG. 5 is a diagram of a piping system as an exemplary configuration of a refrigeration device according to a second embodiment.

FIG. 5 illustrates an exemplary configuration of a refrigeration device (10) according to a second embodiment. For example, the refrigeration device (10) according to the second embodiment is provided in a cooling system (not illustrated) for cooling a cooling target in a cold chamber, and is configured to cool air in the cold chamber. The refrigeration device (10) according to the second embodiment includes a heat source unit (40) and a utilization unit (50).

The heat source unit (40) includes a heat source circuit (41), a heat source fan (16), and a control unit (18). The utilization unit (50) includes a utilization circuit (51) and a utilization fan (17). The heat source circuit (41) of the heat source unit (40) and the utilization circuit (51) of the utilization unit (50) are connected with a gas connection passage (P11) and a liquid connection passage (P12). Specifically, the heat source circuit (41) has a gas end connected to the gas communication passage (P11), and the utilization circuit (51) has a gas end connected to the gas communication passage (P11). The heat source circuit (41) has a liquid end connected to the liquid communication passage (P12), and the utilization circuit (51) has a liquid end connected to the liquid communication passage (P12). The heat source circuit (41) of the heat source unit (40) and the utilization circuit (51) of the utilization unit (50) are connected as described above to constitute a refrigerant circuit (15).

[Heat Source Circuit]

The heat source circuit (41) includes a first compressor (21), a second compressor (22), a four-way switching valve (42), a heat source heat exchanger (23), a receiver (43), a heat source expansion valve (44), a subcooling heat exchanger (45), a subcooling expansion valve (46), an adjustment valve (47), and first to seventh check valves (CV1 to CV7). In this example, the heat source circuit (41) includes two first compressors (21). In the following description, the term "first compressor (21*a*)" refers to one of the two first compressors (21), and the term "first compressor (21*b*)" refers to the other first compressor (21). The heat source circuit (41) also includes first to sixth heat source passages (P41 to P46), an injection passage (P40), and first to third connection passages (P47 to P49). These passages each include, for example, a refrigerant pipe.

<Compressors>

Each first compressor (21*a*, 21*b*) according to the second embodiment is similar in configuration to the first compressor (21) according to the first embodiment. The second compressor (22) according to the second embodiment is similar in configuration to the second compressor (22) according to the first embodiment.

In this example, each of the first compressor (21*a*) and the second compressor (22) is a variable capacity compressor, and the number of rotations (i.e., the operating frequency) of each compressor is adjustable. The first compressor (21*b*) is a fixed capacity compressor, and the number of rotations of the first compressor (21*b*) is fixed.

<Four-Way Switching Valve>

The four-way switching valve (42) has first to fourth ports. The four-way switching valve (42) switches between a first state in which the first port communicates with the third port while the second port communicates with the fourth port (a state indicated by a solid line in FIG. 5) and a second state in which the first port communicates with the fourth port while the second port communicates with the third port (a state indicated by a broken line in FIG. 5).

<Heat Source Heat Exchanger>

The heat source heat exchanger (23) according to the second embodiment is similar in configuration to the heat source heat exchanger (23) according to the first embodiment.

<Receiver>

The receiver (43) is configured to store the refrigerant and to separate the stored refrigerant into the gas refrigerant and the liquid refrigerant. Specifically, the receiver (43) stores the refrigerant flowing into the receiver (43) through an inlet of the receiver (43). The liquid refrigerant in the receiver (43) flows out of the receiver (43) through a liquid outlet of the receiver (43). The gas refrigerant in the receiver (43) flows out of the receiver (43) through a gas outlet (not illustrated) of the receiver (43).

<Passages>

The first heat source passage (P41) connects first discharge pipes (21*d*) respectively connected to the first compressors (21) and the fourth port of the four-way switching valve (42). In this example, the first heat source passage (P41) includes a first passage portion (P41*a*), a second passage portion (P41*b*), and a third passage portion (P41*c*). The first passage portion (P41*a*) connects the first discharge pipe (21*d*) connected to the first compressor (21*a*) and the third passage portion (P41*c*). The second passage portion (P41*b*) connects the first discharge pipe (21*d*) connected to the first compressor (21*b*) and the third passage portion (P41*c*). The third passage portion (P41*c*) is connected to the fourth port of the four-way switching valve (42).

The second heat source passage (P42) connects the second port of the four-way switching valve (42) and a second suction pipe (22*s*) connected to the second compressor (22).

The third heat source passage (P43) connects a second discharge pipe (22*d*) connected to the second compressor (22) and the first port of the four-way switching valve (42). The fourth heat source passage (P44) connects the third port of the four-way switching valve (42) and a gas end of the heat source heat exchanger (23).

The fifth heat source passage (P45) connects a liquid end of the heat source heat exchanger (23) and the liquid communication passage (P12). In this example, the fifth heat source passage (P45) includes a first passage portion (P45*a*) and a second passage portion (P45*b*). The first passage portion (P45*a*) connects the liquid end of the heat source heat exchanger (23) and the inlet of the receiver (43). The second passage portion (P45*b*) connects the liquid outlet of the receiver (43) and the liquid communication passage (P12).

The sixth heat source passage (P46) connects first suction pipes (21*s*) respectively connected to the first compressors (21) and the gas communication passage (P11). In this example, the sixth heat source passage (P46) includes a first passage portion (P46*a*), a second passage portion (P46*b*), and a third passage portion (P46*c*). The first passage portion (P46*a*) connects the first suction pipe (21*s*) connected to the first compressor (21*a*) and the third passage portion (P46*c*). The second passage portion (P46*b*) connects the first suction pipe (21*s*) connected to the first compressor (21*b*) and the third passage portion (P46*c*). The third passage portion (P46*c*) is connected to the gas communication passage (P11).

The injection passage (P40) has a first end connected to a first midway portion (Q1) of the fifth heat source passage (P45). The injection passage (P40) also has a second end connected to a first oil drain passage (P31) of an oil circuit (30).

The first connection passage (P47) connects a second midway portion (Q2) and a third midway portion (Q3) of the fifth heat source passage (P45). The second midway portion (Q2) is located between the receiver (43) and the first midway portion (Q1) on the fifth heat source passage (P45). The third midway portion (Q3) is located between the heat source heat exchanger (23) and the receiver (43) on the fifth heat source passage (P45).

The second connection passage (P48) connects a fourth midway portion (Q4) and a fifth midway portion (Q5) of the fifth heat source passage (P45). The fourth midway portion (Q4) is located between the receiver (43) and the second midway portion (Q2) on the fifth heat source passage (P45). The fifth midway portion (Q5) is located between the heat source heat exchanger (23) and the third midway portion (Q3) on the fifth heat source passage (P45).

The third connection passage (P49) connects the third passage portion (P41*c*) of the first heat source passage (P41) and the third passage portion (P46*c*) of the sixth heat source passage (P46).

<Heat Source Expansion Valve>

The heat source expansion valve (44) is disposed between the receiver (43) and the fourth midway portion (Q4) on the fifth heat source passage (P45). The heat source expansion valve (44) has an adjustable opening degree. The heat source expansion valve (44) is, for example, an electric valve. It should be noted that the heat source expansion valve (44) is an example of an expansion mechanism (24).

<Subcooling Heat Exchanger>

The subcooling heat exchanger (45) is connected to the fifth heat source passage (P45) and the injection passage (P40), and is configured to cause the refrigerant flowing through the fifth heat source passage (P45) to exchange heat with the refrigerant flowing through the injection passage (P40).

In this example, the subcooling heat exchanger (45) includes a first refrigerant passage (45*a*) incorporated in the fifth heat source passage (P45) and a second refrigerant passage (45*b*) incorporated in the injection passage (P40). The first refrigerant passage (45*a*) is located between the second midway portion (Q2) and the fourth midway portion (Q4) on the fifth heat source passage (P45). The subcooling heat exchanger (45) causes the refrigerant flowing through the first refrigerant passage (45*a*) to exchange heat with the refrigerant flowing through the second refrigerant passage (45*b*). The subcooling heat exchanger (45) is, for example, a plate heat exchanger.

<Subcooling Expansion Valve>

The subcooling expansion valve (46) is disposed between the first midway portion (Q1) of the fifth heat source passage (P45) and the subcooling heat exchanger (45), on the injection passage (P40). The subcooling expansion valve (46) has an adjustable opening degree.

The subcooling expansion valve (46) is, for example, an electric valve.

<Adjustment Valve>

The adjustment valve (47) is disposed on the third connection passage (P49). The adjustment valve (47) has an adjustable opening degree. The adjustment valve (47) is, for example, an electric valve.

<Check Valves>

The first check valve (CV1) is disposed on the first passage portion (P41*a*) of the first heat source passage (P41). The second check valve (CV2) is disposed on the second passage portion (P41*b*) of the first heat source passage (P41). The third check valve (CV3) is disposed on the third heat source passage (P43). The fourth check valve (CV4) is disposed between the third midway portion (Q3) and the fifth midway portion (Q5) on the fifth heat source passage (P45). The fifth check valve (CV5) is disposed between the fourth midway portion (Q4) and the subcooling heat exchanger (45) on the fifth heat source passage (P45). The sixth check valve (CV6) is disposed on the first connection passage (P47). The seventh check valve (CV7) is disposed on the second connection passage (P48).

The first to seventh check valves (CV1 to CV7) each permit the flow of the refrigerant in a direction indicated by an arrow in FIG. 5 and prohibit the flow of the refrigerant in the opposite direction to the direction indicated by the arrow in FIG. 5.

[Oil Circuit]

In the second embodiment, as in the first embodiment, the refrigerant circuit (15) is provided with an oil circuit (30). The oil circuit (30) according to the second embodiment is similar in configuration to the oil circuit (30) according to the first embodiment. The oil circuit (30) according to the second embodiment includes an oil separator (31), an oil drain valve (32), an oil feed valve (33), and a drain oil check valve (34). The oil circuit (30) also includes a first oil drain passage (P31), a second oil drain passage (P32), a first oil feed passage (P33), and a second oil feed passage (P34).

In this example, the oil circuit (30) includes three oil drain valves (32). One of the three oil drain valves (32) is an upstream oil drain valve (35), and the other two are downstream oil drain valves (36). In the following description, the term "downstream oil drain valve (36*a*)" refers to one of the two downstream oil drain valves (36), and the term "downstream oil drain valve (36*b*)" refers to the other downstream oil drain valve (36).

Also in this example, the oil circuit (30) includes two drain oil check valves (34). In the following description, the term "drain oil check valve (34*a*)" refers to one of the two drain oil check valves (34), and the term "drain oil check valve (34*b*)" refers to the other drain oil check valve (34).

<First Oil Drain Passage>

The first oil drain passage (P31) guides the oil in the second compressor (22) to intermediate ports (21*i*) of the first compressors (21), without via a high-pressure passage (P21). In this example, the first oil drain passage (P31) includes a first passage portion (P31*a*), a second passage portion (P31*b*), and a third passage portion (P31*c*). The first passage portion (P31*a*) connects the intermediate port (21*i*) of the first compressor (21*a*) and the third passage portion (P31*c*). The second passage portion (P31*b*) connects the intermediate port (21*i*) of the first compressor (21*b*) and the third passage portion (P31*c*). The third passage portion (P31*c*) is connected to the second compressor (22).

<Second Oil Drain Passage>

The second oil drain passage (P32) guides the oil in each first compressor (21) to the intermediate passage (P20). In this example, the second oil drain passage (P32) includes a first passage portion (P32*a*), a second passage portion (P32*b*), and a third passage portion (P32*c*). The first passage portion (P32*a*) connects the first compressor (21*a*) and the third passage portion (P32*c*). The second passage portion (P32*b*) connects the first compressor (21*b*) and the third passage portion (P32*c*). The third passage portion (P32*c*) is connected to the second heat source passage (P42).

<Oil Separator>

The oil separator (31) is disposed between the third check valve (CV3) and the four-way switching valve (42) on the third heat source passage (P43). The oil separator (31) according to the second embodiment is similar in configuration to the oil separator (31) according to the first embodiment.

<First Oil Feed Passage>

The first oil feed passage (P33) is configured to guide the oil in the oil separator (31) to the first oil drain passage (P31). In this example, the first oil feed passage (P33) has an inlet connected to the oil separator (31). The first oil feed passage (P33) also has an outlet connected to a first midway portion (Q6) of the first oil drain passage (P31). The first midway portion (Q6) is located on the third passage portion (P31*c*) of the first oil drain passage (P31).

<Second Oil Feed Passage>

The second oil feed passage (P34) is configured to guide the oil in the oil separator (31) to the second compressor (22). In this example, the second oil feed passage (P34) guides the oil in the oil separator (31) to an intermediate port (22*i*) of the second compressor (22). The second oil feed passage (P34) has an inlet connected to the first oil feed passage (P33). The second oil feed passage (P34) also has an outlet connected to the intermediate port (22*i*) of the second compressor (22).

<Upstream Oil Drain Valve>

The upstream oil drain valve (35) is disposed upstream of a joint between the first oil drain passage (P31) and the first oil feed passage (P33), on the first oil drain passage (P31). In this example, the upstream oil drain valve (35) is disposed upstream of the first midway portion (Q6), on the third passage portion (P31*c*) of the first oil drain passage (P31). It should be noted that the upstream oil drain valve (35) according to the second embodiment is similar in configuration to the upstream oil drain valve (35) according to the first embodiment.

<Downstream Oil Drain Valves>

Each downstream oil drain valve (36) is disposed downstream of a joint between the corresponding first oil drain passage (P31) and the first oil feed passage (P33), on the first oil drain passage (P31). In this example, the downstream oil drain valve (36*a*) is disposed on the first passage portion (P31*a*) of the first oil drain passage (P31). The downstream oil drain valve (36*b*) is disposed on the second passage portion (P31*b*) of the first oil drain passage (P31). Each downstream oil drain valve (36*a*, 36*b*) according to the second embodiment is similar in configuration to the downstream oil drain valve (36) according to the first embodiment.

<Oil Feed Valve>

The oil feed valve (33) is disposed on the first oil feed passage (P33). In this example, the oil feed valve (33) is disposed downstream of a joint between the first oil feed passage (P33) and the second oil feed passage (P34), on the first oil feed passage (P33). It should be noted that the oil feed valve (33) according to the second embodiment is similar in configuration to the oil feed valve (33) according to the first embodiment.

<Drain Oil Check Valve>

The drain oil check valve (34*a*) is disposed on the first passage portion (P32*a*) of the second oil drain passage (P32). The drain oil check valve (34*a*) permits a flow of the oil from the first compressor (21*a*) to the third passage portion (P32*c*) of the second oil drain passage (P32) and prohibits a flow of the oil from the third passage portion (P32*c*) of the second oil drain passage (P32) to the first compressor (21*a*). The drain oil check valve (34*b*) is disposed on the second passage portion (P32*b*) of the second oil drain passage (P32). The drain oil check valve (34*b*) permits a flow of the oil from the first compressor (21*b*) to the third passage portion (P32*c*) of the second oil drain passage (P32) and prohibits a flow of the oil from the third passage portion (P32*c*) of the second oil drain passage (P32) to the first compressor (21*b*).

<Connection Between First Oil Drain Passage and Injection Passage>

In the second embodiment, the injection passage (P40) is connected to the first oil drain passage (P31). Specifically, the injection passage (P40) has an outlet connected to a second midway portion (Q7) of the first oil drain passage (P31). The second midway portion (Q7) is disposed downstream of the first midway portion (Q6) on the third passage portion (P31*c*) of the first oil drain passage (P31).

[Utilization Circuit]

The utilization circuit (51) includes a utilization heat exchanger (25), a utilization expansion valve (52), and a drain pan heater (53). The utilization circuit (51) also includes a first utilization passage (P51) and a second utilization passage (P52). These passages each include, for example, a refrigerant pipe.

<Utilization Heat Exchanger>

The utilization heat exchanger (25) according to the second embodiment is similar in configuration to the utilization heat exchanger (25) according to the first embodiment.

<Passages>

The first utilization passage (P51) connects the liquid communication passage (P12) and a liquid end of the utilization heat exchanger (25). The second utilization passage (P52) connects a gas end of the utilization heat exchanger (25) and the gas communication passage (P11).

<Utilization Expansion Valve>

The utilization expansion valve (52) is disposed on the first utilization passage (P51). The utilization expansion valve (52) has an adjustable opening degree. The utilization expansion valve (52) is, for example, an electric valve. It should be noted that the utilization expansion valve (52) is an example of the expansion mechanism (24).

<Drain Pan Heater>

The drain pan heater (53) is disposed between the liquid communication passage (P12) and the utilization expansion valve (52) on the first utilization passage (P51). The drain pan heater (53) is a pipe disposed for heating, with the refrigerant, a drain pan (not illustrated) disposed below the utilization heat exchanger (25).

[Various Sensors]

In the second embodiment, as in the first embodiment, the heat source unit (40) and utilization unit (50) of the refrigeration device (10) each include various sensors such as a pressure sensor and a temperature sensor. The various sensors each transmit a detection signal indicating a detection result to the control unit (18). In this example, the various sensors of the heat source unit (40) of the refrigeration device (10) include a temperature sensor (S21).

[Control Unit]

Figure 6:
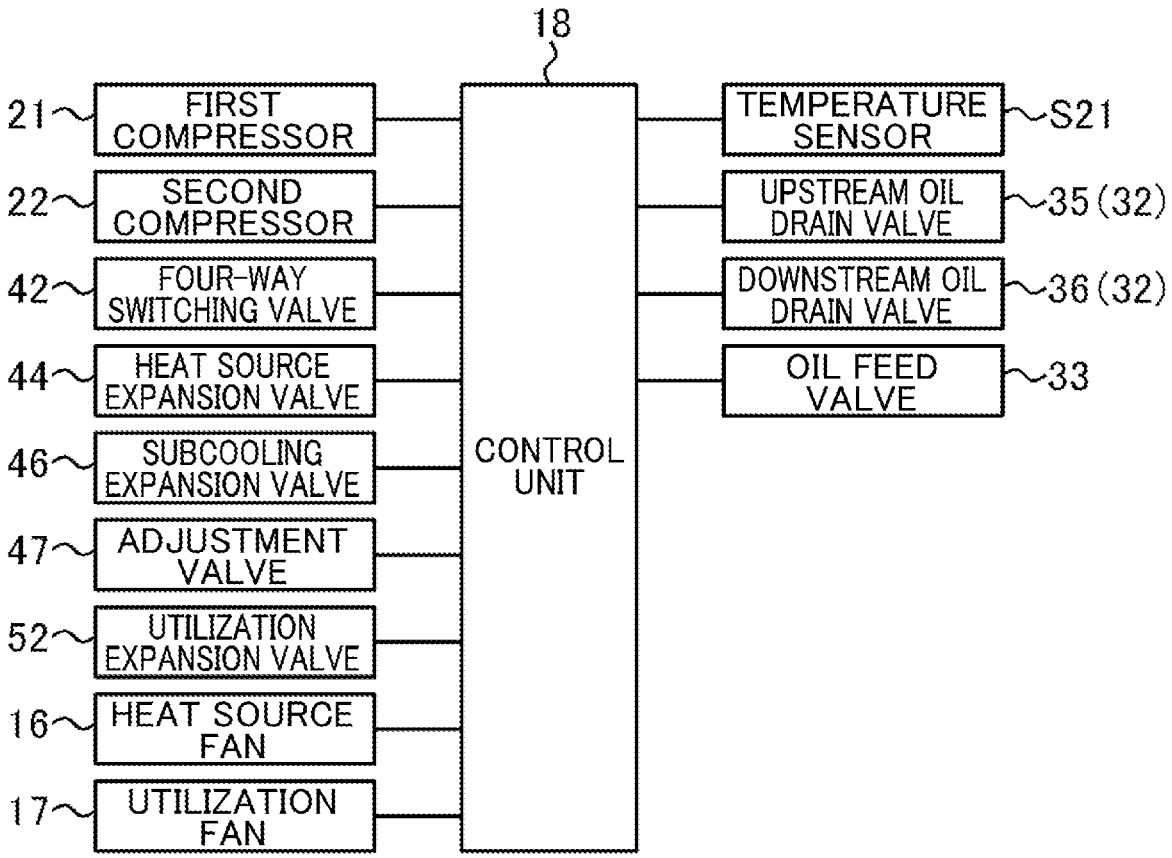
FIG. 6 is a block diagram of an exemplary configuration of a control unit according to the second embodiment.

The control unit (18) according to the second embodiment is similar in configuration to the control unit (18) according to the first embodiment. As illustrated in FIG. 6, the control unit (18) is connected to, for example, the first compressors (21), the second compressor (22), the four-way switching valve (42), the heat source expansion valve (44), the subcooling expansion valve (46), the adjustment valve (47), the utilization expansion valve (52), the heat source fan (16), and the utilization fan (17).

In the second embodiment, as in the first embodiment, the control unit (18) controls the respective constituent elements of the refrigeration device (10), based on detection signals from the various sensors of the refrigeration device (10) and an external signal transmitted outside the refrigeration device (10). The action of the refrigeration device (10) is thus controlled.

[Compression Device]

In the refrigeration device (10) according to the second embodiment, the first compressors (21), the second compressor (22), the four-way switching valve (42), the intermediate passage (P20), the high-pressure passage (P21), and the oil circuit (30) constitute a compression device (11). The compression device (11) is configured to supply the compressed refrigerant to a radiator (the heat source heat exchanger (23) in this example).

[Intermediate Passage and High-Pressure Passage]

It should be noted that the intermediate passage (P20) according to the second embodiment includes the first heat source passage (P41) and the second heat source passage (P42). The high-pressure passage (P21) according to the second embodiment includes the third heat source passage (P43) and the fourth heat source passage (P44).

[Operation]

Next, a description will be given of an operation to be carried out by the refrigeration device (10) according to the second embodiment. The refrigeration device (10) according to the second embodiment carries out a cooling operation. During the cooling operation, the first compressors (21*a*, 21*b*), the second compressor (22), the heat source fan (16), and the utilization fan (17) are driven. The heat source heat exchanger (23) functions as a radiator while the utilization heat exchanger (25) functions as an evaporator. The heat source expansion valve (44) is set at a fully open state. The opening degree of the subcooling expansion valve (46) is adjusted. The opening degree of the utilization expansion valve (52) is adjusted. The adjustment valve (47) is set at an open state in a case where the two first compressors (21*a*, 21*b*) stop. The adjustment valve (47) is set at a closed state in a case where at least one of the two first compressors (21*a*, 21*b*) is driven.

[Flow of Refrigerant During Operation]

Next, a description will be given of the flow of the refrigerant during the cooling operation carried out by the refrigeration device (10) according to the second embodiment.

In the heat source unit (40), the refrigerant is discharged from each first compressor (21*a*, 21*b*). The refrigerant then passes through the first heat source passage (P41), the four-way switching valve (42), and the second heat source passage (P42). The refrigerant is then sucked into and compressed by the second compressor (22). The refrigerant (the high-pressure refrigerant) is then discharged from the second compressor (22). The refrigerant then flows into the heat source heat exchanger (23) via the third heat source passage (P43), the four-way switching valve (42), and the fourth heat source passage (P44), and dissipates heat in the heat source heat exchanger (23). The refrigerant then flows out of the heat source heat exchanger (23). The refrigerant then flows through the fifth heat source passage (P45). The refrigerant then flows into the first refrigerant passage (45*a*) of the subcooling heat exchanger (45) via the receiver (43) and the heat source expansion valve (44) in the fully open state. The heat of the refrigerant flowing through the first refrigerant passage (45*a*) of the subcooling heat exchanger (45) is absorbed by the refrigerant flowing through the second refrigerant passage (45*b*) of the subcooling heat exchanger (45). The refrigerant then flows out of the first refrigerant passage (45*a*) of the subcooling heat exchanger (45). A part of the refrigerant then flows into the injection passage (P40) while the remaining flows into the first utilization passage (P51) of the utilization unit (50) via the liquid communication passage (P12).

The refrigerant flowing through the injection passage (P40) is decompressed by the subcooling expansion valve (46). The refrigerant then flows through the second refrigerant passage (45*b*) of the subcooling heat exchanger (45). The refrigerant then flows into the first oil drain passage (P31). The refrigerant flowing through the first oil drain passage (P31) via the injection passage (P40) then flows into each first compressor (21*a*, 21*b*) through the corresponding intermediate port (21*i*), together with the oil flowing through the first oil drain passage (P31).

The refrigerant flowing through the first utilization passage (P51) of the utilization unit (50) dissipates heat in the drain pan heater (53). The refrigerant is then decompressed by the utilization expansion valve (52). The refrigerant then evaporates in the utilization heat exchanger (25). The refrigerant then flows out of the utilization heat exchanger (25). The refrigerant then passes through the second utilization passage (P52), the gas communication passage (P11), and the sixth heat source passage (P46) of the heat source unit (40). The refrigerant is then sucked into and compressed by each first compressor (21*a*, 21*b*).

[Flow of Oil During Operation]

Next, a description will be given of the flow of the oil during the cooling operation carried out by the refrigeration device (10) according to the second embodiment.

The oil flowing through the second compressor (22) then flows into the third passage portion (P31*c*) of the first oil drain passage (P31). The oil then passes through the upstream oil drain valve (35). The oil is then diverted to the first passage portion (P31*a*) of the first oil drain passage (P31) and the second passage portion (P31*b*) of the first oil drain passage (P31). The oil flowing through the first passage portion (P31*a*) of the first oil drain passage (P31) then flows into the first compressor (21*a*) through the intermediate port (21*i*). The oil flowing through the second passage portion (P31*b*) of the first oil drain passage (P31) then flows into the first compressor (21*b*) through the intermediate port (21*i*).

The oil flowing through the first compressor (21*a*) then flows into the first passage portion (P32*a*) of the second oil drain passage (P32). The oil then flows through the third passage portion (P32*c*) of the second oil drain passage (P32). The oil flowing through the first compressor (21*b*) then flows into the second passage portion (P32*b*) of the second oil drain passage (P32). The oil then flows through the third passage portion (P32*c*) of the second oil drain passage (P32). The oil flowing through the third passage portion (P32*c*) of the second oil drain passage (P32) then flows into the second heat source passage (P42). The refrigerant is then sucked into the second compressor (22).

The oil then flows out of the oil separator (31) and flows into the first oil feed passage (P33). A part of the oil then passes through the second oil feed passage (P34) and flows into the second compressor (22) through the intermediate port (22*i*) while the remaining flows into the third passage portion (P31*c*) of the first oil drain passage (P31) via the oil feed valve (33).

[Control of Oil Drain Valve and Oil Feed Valve]

In the refrigeration device (10) according to the second embodiment, the control unit (18) controls the oil drain valves (32) and the oil feed valve (33) during the cooling operation. The control of the oil drain valves (32) and oil feed valve (33) in the second embodiment is similar to the control of the oil drain valves (32) and oil feed valve (33) in the first embodiment. For example, the control unit (18) controls the oil drain valves (32) as follows.

When the temperature of the oil detected by the temperature sensor (S21) is equal to or less than the first temperature, the control unit (18) brings each oil drain valve (32) into the open state. In this example, the control unit (18) brings both the upstream oil drain valve (35) and the downstream oil drain valves (36*a*, 36*b*) into the open state.

When the temperature of the oil detected by the temperature sensor (S21) is more than the first temperature, the control unit (18) brings one of or each of the oil drain valves (32) into the closed state. In this example, the control unit (18) brings one of or each of the upstream oil drain valve (35) and the downstream oil drain valves (36*a*, 36*b*) into the closed state.

Advantageous Effects of Second Embodiment

The refrigeration device (10) according to the second embodiment is capable of producing advantageous effects similar to the advantageous effects of the refrigeration device (10) according to the first embodiment.

Other Embodiments

The foregoing description concerns the exemplary case where the first compressor (21) is constituted of a single compressor; however, the present disclosure is not limited to this exemplary case. For example, the first compressor (21) may be constituted of multiple-stage compressors connected in series. In this case, the intermediate port (21*i*) of the first compressor (21) may be a given node on a passage between two of the multiple-stage compressors constituting the first compressor (21) (i.e., a passage connecting a discharge pipe connected to a lower stage-side compressor and a suction pipe connected to a higher stage-side compressor). In other words, the outlet of the first oil drain passage (P31) may be connected to a given node on a passage between two of the multiple-stage compressors constituting the first compressor (21).

The foregoing description also concerns the exemplary case where the second compressor (22) is constituted of a single compressor; however, the present disclosure is not limited to this exemplary case. For example, the second compressor (22) may be constituted of multiple-stage compressors connected in series. In this case, the intermediate port (22*i*) of the second compressor (22) may be a given node on a passage between two of the multiple-stage compressors constituting the second compressor (22). In other words, the outlet of the second oil feed passage (P34) may be connected to a given node on a passage between two of the multiple-stage compressors constituting the second compressor (22).

The foregoing description also concerns the exemplary case where the opening degrees of the oil drain valves (32) (i.e., the upstream oil drain valve (35) and the downstream oil drain valve (36)) are adjustable; however, the present disclosure is not limited to this exemplary case. For example, the oil drain valves (32) may be switchable between an open state and a closed state. Specifically, each of the oil drain valves (32) may be an open-close valve. In a case where each of the oil drain valves (32) is an open-close valve, a decompression mechanism may be disposed together with each oil drain valve (32) on the first oil drain passage (P31). The decompression mechanism is, for example, a capillary tube. The same thing may hold true for the oil feed valve (33).

The foregoing ordinal numbers such as "first", "second", and "third" are merely used for distinguishing the elements designated with the ordinal numbers, and are not intended to limit the number and order of the elements.

While the embodiments and modifications have been described herein above, it is to be appreciated that various changes in form and detail may be made without departing from the spirit and scope presently or hereafter claimed. In addition, the foregoing embodiments and modifications may be appropriately combined or substituted as long as the combination or substitution does not impair the functions of the present disclosure.

INDUSTRIAL APPLICABILITY

As described above, the present disclosure is useful as a refrigeration device.

REFERENCE SIGNS LIST

10: refrigeration device
11: compression device
15: refrigerant circuit
16: heat source fan
17: utilization fan
18: control unit
21: first compressor
22: second compressor
23: heat source heat exchanger (radiator)
24: expansion mechanism
25: utilization heat exchanger (evaporator)
P20: intermediate passage
P21: high-pressure passage
P22: communication passage P23: low-pressure passage
S21: temperature sensor
30: oil circuit
31: oil separator
32: oil drain valve
33: oil feed valve
34: drain oil check valve
35: upstream oil drain valve
36: downstream oil drain valve
P31: first oil drain passage
P32: second oil drain passage
P33: first oil feed passage
P34: second oil feed passage
100: casing
200: compression mechanism
201: fixed scroll
202: movable scroll
203: compression chamber
300: electric motor

The invention claimed is:

1. A refrigeration device comprising:
a refrigerant circuit including
a first compressor connected to a first suction pipe and a first discharge pipe and configured to compress a refrigerant,
a second compressor connected to a second suction pipe and a second discharge pipe and configured to compress the refrigerant discharged from the first compressor,
a radiator,
a high-pressure passage connecting the second discharge pipe and the radiator;
a first oil drain passage;
an oil separator disposed on the high-pressure passage and configured to separate an oil from the refrigerant discharged from the second compressor;
a first oil feed passage configured to guide the oil in the oil separator to the first oil drain passage, not via the second compressor,
a second oil feed passage configured to guide the oil in the oil separator to the second compressor,
wherein
the first oil drain passage guides an oil in the second compressor to one of the first suction pipe and an intermediate port of the first compressor, without via the high-pressure passage.

2. A refrigeration device comprising
a refrigerant circuit including
a first compressor connected to a first suction pipe and a first discharge pipe and configured to compress a refrigerant,
a second compressor connected to a second suction pipe and a second discharge pipe and configured to compress the refrigerant discharged from the first compressor,
a radiator, and
a high-pressure passage connecting the second discharge pipe and the radiator;
a first oil drain passage,
an oil separator disposed on the high-pressure passage and configured to separate an oil from the refrigerant discharged from the second compressor;
a first oil feed passage configured to guide the oil in the oil separator to the first oil drain passage, and
a second oil feed passage configured to guide the oil in the oil separator to the second compressor,
wherein
the first oil drain passage guides an oil in the second compressor to one of the first suction pipe and an intermediate port of the first compressor, without via the high-pressure passage.

3. The refrigeration device according to claim 2, wherein
the second oil feed passage guides the oil in the oil separator to an intermediate port of the second compressor.

4. The refrigeration device according to claim 2, wherein
the second oil feed passage has an inlet connected to the first oil feed passage.

5. The refrigeration device according to claim 1, further comprising
an oil feed valve disposed on the first oil feed passage.

6. The refrigeration device according to claim 1, further comprising
a downstream oil drain valve disposed downstream of a joint between the first oil drain passage and the first oil feed passage, on the first oil drain passage.

7. The refrigeration device according to claim 1, further comprising
an upstream oil drain valve disposed upstream of a joint between the first oil drain passage and the first oil feed passage, on the first oil drain passage.

8. The refrigeration device according to claim 1, further comprising
an oil drain valve disposed on the first oil drain passage.

9. The refrigeration device according to claim 8, further comprising:
a temperature sensor configured to detect a temperature of the oil on the first oil drain passage; and
a control unit configured to bring the oil drain valve into an open state on condition that the temperature of the oil detected by the temperature sensor is equal to or less than a predetermined first temperature and configured to bring the oil drain valve into a closed state on condition that the temperature of the oil detected by the temperature sensor is more than the first temperature.

10. The refrigeration device according to claim 1, further comprising
a second oil drain passage,
wherein
the refrigerant circuit includes an intermediate passage connecting the first discharge pipe and the second suction pipe, and
the second oil drain passage guides the oil in the first compressor to the intermediate passage.

11. The refrigeration device according to claim 1, wherein
the second compressor includes:
a casing;
a compression mechanism accommodated in the casing; and
an electric motor accommodated in the casing and configured to drive the compression mechanism, and
the first oil drain passage has an inlet located lower than the electric motor in the casing.

12. The refrigeration device according to claim 1, wherein
the first compressor includes:
a fixed scroll; and
a movable scroll configured to mesh with the fixed scroll to define a compression chamber between the movable scroll and the fixed scroll,
the intermediate port of the first compressor communicates with the compression chamber midway through compression by the first compressor, and the first oil drain passage guides the oil in the second compressor to the intermediate port of the first compressor, without via the high-pressure passage.

13. The refrigeration device according to claim 1, wherein the second compressor is a high-pressure dome compressor.

14. A compression device for supplying a compressed refrigerant to a radiator, the compression device comprising:

a first compressor connected to a first suction pipe and a first discharge pipe and configured to compress a refrigerant;

a second compressor connected to a second suction pipe and a second discharge pipe and configured to compress the refrigerant discharged from the first compressor;

a high-pressure passage connecting the second discharge pipe and the radiator;

a first oil drain passage;

an oil separator disposed on the high-pressure passage and configured to separate an oil from the refrigerant discharged from the second compressor; and a first oil feed passage configured to guide the oil in the oil separator to the first oil drain passage, not via the second compressor, wherein the first oil drain passage guides an oil in the second compressor to one of the first suction pipe and an intermediate port of the first compressor, without via the high-pressure passage.

15. The refrigeration device according to claim 3, wherein the second oil feed passage has an inlet connected to the first oil feed passage.

16. The refrigeration device according to claim 2, further comprising an oil feed valve disposed on the first oil feed passage.

17. The refrigeration device according to claim 3, further comprising an oil feed valve disposed on the first oil feed passage.

18. The refrigeration device according to claim 4, further comprising an oil feed valve disposed on the first oil feed passage.

* * * * *